US008371769B2

(12) United States Patent
Worsley et al.

(10) Patent No.: US 8,371,769 B2
(45) Date of Patent: Feb. 12, 2013

(54) PAVING MACHINE CONTROL AND METHOD

(75) Inventors: Andrew James Worsley, Christchurch (NZ); Jason Grier Lindsay Hill, Christchurch (NZ)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 244 days.

(21) Appl. No.: 12/759,846

(22) Filed: Apr. 14, 2010

(65) Prior Publication Data

US 2011/0255918 A1 Oct. 20, 2011

(51) Int. Cl.
*E01C 23/07* (2006.01)

(52) U.S. Cl. ..... 404/84.2; 404/84.1; 404/118

(58) Field of Classification Search ..... 404/84.1, 404/84.2, 118
See application file for complete search history.

(56) References Cited

U.S. PATENT DOCUMENTS 5,258,961 A * 11/1993 Sehr et al. ..... 367/96
5,393,167 A * 2/1995 Fujita et al. ..... 404/84.1
5,401,115 A * 3/1995 Musil et al. ..... 404/72
5,549,412 A 8/1996 Malone
5,752,783 A 5/1998 Malone
6,027,282 A 2/2000 Horn
7,172,363 B2 2/2007 Olson et al.
7,399,139 B2 7/2008 Kieranen et al.
7,654,769 B2 * 2/2010 Herrmann ..... 404/75
8,070,385 B2 * 12/2011 Green ..... 404/84.5
8,079,776 B2 * 12/2011 Lossow ..... 404/84.5
2009/0223358 A1 9/2009 Green
2009/0226255 A1 9/2009 Lossow
2010/0014916 A1 1/2010 Green
2010/0150650 A1 * 6/2010 Buschmann et al. ..... 404/82
2010/0150651 A1 * 6/2010 Buschmann et al. ..... 404/82

* cited by examiner

*Primary Examiner* — Gary S Hartmann
(74) *Attorney, Agent, or Firm* — Dinsmore & Shohl LLP

(57) ABSTRACT

A control and a method of control for a machine that applies a material to a subgrade at a work site and pulls a floating screed, having a screed plate, over the top surface of the material behind the machine is useful in paving with asphalt material. The floating screed is attached to the machine by a tow arm at a tow point on said tow arm. The vertical height of the tow point is controlled by an hydraulic cylinder on said machine in response to a valve control signal applied to an hydraulic valve by a valve control drive. The screed determines the thickness of the material on the subgrade and is manipulated by adjusting the height of the tow point. A first sensor is mounted on the floating screed for sensing three-dimensional position. A second sensor for senses the pitch of said screed. A processor circuit is responsive to the first and second sensors for determining the height of the trailing edge of the screed plate and the movement of the screed over the top surface of the material. An adjusted height error value is combined with a tow point correction value produced by a three dimensional positioning system to provide for adjustment of the tow point by no more than a predetermined amount as the screed plate travels a predetermined minimum distance.

18 Claims, 8 Drawing Sheets

PAVING MACHINE CONTROL AND METHOD

CROSS-REFERENCE TO RELATED APPLICATION

Not applicable.

STATEMENT REGARDING FEDERALLY SPONSORED RESEARCH OR DEVELOPMENT

Not applicable.

BACKGROUND OF THE INVENTION

This relates to an improved control for a paving machine and method of machine operation and, more particularly, to such a control and method for controlling paving machines having incorporate screeds that are drawn over the surface of a paved area, contouring the surface.

Paving machines of this type typically include a tractor or towing vehicle that moves ahead of a screed over a subgrade to be paved. The paving machine deposits a layer of asphalt or other paving material on the subgrade, and the thickness and contour of the asphalt layer are determined by a "floating" screed that is towed behind the towing vehicle. The screed has a plate on its lower surface that rides up over the asphalt that is deposited behind the vehicle. The screed includes a pair of forward extending tow arms that are connected to the vehicle at tow points. The tow points are raised and lowered by hydraulic cylinders on the towing vehicle. When the tow points are raised, the front edge of the screed plate is raised and the angle of attack of the screed plate is changed such that it planes upward over the asphalt that is being deposited on the subgrade just ahead of the screed. This results in the top surface of the asphalt layer rising in height and a thicker layer of asphalt on the subgrade. Conversely, when the tow points are lowered, the front edge of the screed plate is also lowered, reorienting the plate to plane downward, and lowering the top surface of the asphalt layer. It will be appreciated, that the screed smoothes the top surface of the layer of the paving material, while at the same time controlling the vertical position of this surface and the thickness of the asphalt layer.

The paving machine deposits the paving material on the subgrade so that the top surface of the paving material follows a desired elevation contour. In some instances, the top surface of the asphalt is contoured in relation to an adjacent reference surface. For example, when a second strip of asphalt is deposited on a roadbed next to a first strip of asphalt, it is desired that the surface height of the two strips match precisely at the seam where they abut. As another example, when an asphalt layer is deposited on a subgrade next to an existing street curb, it may be desired that the asphalt surface height be controlled precisely with respect to the curb. In other cases, the asphalt is contoured to match a reference set by a surveyor. For example, a surveyor may have previously surveyed a road or other surface to be paved, and set a series of stakes with a reference string line running from the top of one stake to the top of the next stake. In all of these instances, it is necessary that the vertical position of the top surface of the deposited paving material be controlled precisely with respect to a reference of some sort, and this requires that the tow points of the tow arms be controlled with precision. In other paving operations, the desired contour of the paved surface is defined in a three dimensional database, and the location of the paver, including the screed, is monitored by means of GPS receivers, laser receivers, automated total station systems, or similar systems. In these cases, the paver is operated to deposit a layer of paving material which matches in contour and thickness the parameters defined in the database.

Paving machine screeds have been controlled in a number of ways. When the level of the asphalt surface is to follow a reference surface adjacent the area to be paved, such as a previously paved surface or a string line positioned by a surveyor, it has been common to measure the vertical position of the reference surface with one or more sensors. The sensors determine the distances to the reference surface, and these distances can be used to control the height of the tow point. The tow point on the opposite side of the machine may be raised and lowered by the same amount, or it may be controlled independently using other sensors.

It will be appreciated that if the paving machine is not moving, simply raising the tow point will not cause the level of the asphalt at the trailing edge of the screed plate to change. Any change in level of the top surface of the asphalt must be accomplished slowly and without overshoot to maintain a smooth, ripple free surface on the asphalt. As a consequence, it has been common to measure the vertical reference height elsewhere along the screed. This approach may require that the level of the screed be manually adjusted from time to time, however.

The control system for a screed of this type experiences differing measurement gain, depending on where on the screed the reference height sensor is located. For example, if the height sensor location is close to the tow point of the screed tow arm, the system will be more proficient at keeping the tow point at a constant height as the paving machine moves over uneven terrain. It would be expected that this would result in a smooth asphalt surface behind the screed. However, the height accuracy, or asphalt mat thickness control at the back of the screed may not be very good, because this depends on the screed angle of attack, which is not controlled, either directly or indirectly. Since with such an arrangement, there is a significant distance between the sensor and the trailing edge of the screed, error in the angle of attack of the screed is amplified as a height error at the back edge of the screed. Conversely, if the height sensor is positioned close to the trailing edge of the screed, the screed exit height is might be thought to be closer to the target height or mat thickness, since an error in the screed angle of attack is not propagated over such a large distance. However, the feedback gain is relatively low in this case (i.e., there is only a small movement detected by the sensor in response to a relatively large change in tow point height), and hence any sensor measurement error will result in larger movements of the tow point cylinders. This, in turn, reduces the smoothness of resulting asphalt surface.

It is desirable to be able to measure the height of the asphalt at the trailing edge of the screed plate and to make an appropriate adjustment without the need for manual control by an operator. Accordingly, it is seen that there is a need for an improved paving machine control and method of machine control.

SUMMARY

A control is provided for a machine that applies a material such as asphalt to a subgrade at a work site and pulls a floating screed having a screed plate over the top surface of the material behind the machine. The floating screed is attached to the machine by a tow arm at a tow point on the tow arm. The vertical height of the tow point is controlled by an hydraulic cylinder on the machine in response to a valve control signal applied to an hydraulic valve by a valve control drive. The screed position determines the thickness of the material on the subgrade and is manipulated by adjusting the height of the tow point. The control includes a first sensor, mounted on the floating screed, for sensing three-dimensional position, and a second sensor sensing the pitch of the screed. A processor circuit is responsive to the first and second sensors for determining the height of the screed plate beneath the first sensor, the height of the trailing edge of the screed plate behind the first sensor, and the movement of the screed over the top surface of the material. The processor circuit derives an adjusted height error value to the valve control drive such that the tow point may be adjusted by no more than a predetermined amount as the screed plate travels a predetermined minimum distance. The adjusted height error value may be combined with a tow point correction value from a three dimensional positioning system.

The first sensor comprises any of a number of types of sensors, mounted on the screed, for sensing the height of the material surface. For example, the first sensor may be a target for a robotic station, a GPS receiver, or other sensor. The second sensor comprises an inclinometer mounted on the screed. The processor circuit may be implemented in a programmable computer.

A method of controlling a machine that applies a material to a subgrade and pulls a floating screed having a screed plate over the top surface of the material behind the machine is provided. The floating screed is attached to the machine by a tow arm at a tow point on the tow arm. The vertical height of the tow point is controlled by an hydraulic cylinder on the machine. The screed determines the thickness of the material on the subgrade. The screed is manipulated by adjusting the height of the tow point in response to a tow point correction value provided by a three dimensional positioning system. The method includes the steps of sensing the three-dimensional position of the trailing edge of the screed; determining the height of the trailing edge of the screed plate and the movement of the screed over the top surface of the material; comparing the desired height of the trailing edge of the screed plate with the determined height of the trailing edge of the screed plate, and deriving a height error value; adjusting the height error value; and combining the adjusted height error value with a tow point correction value such that the tow point may be adjusted by no more than a predetermined amount as the screed plate travels a predetermined minimum distance.

DETAILED DESCRIPTION OF THE PREFERRED EMBODIMENTS

Figure 1:
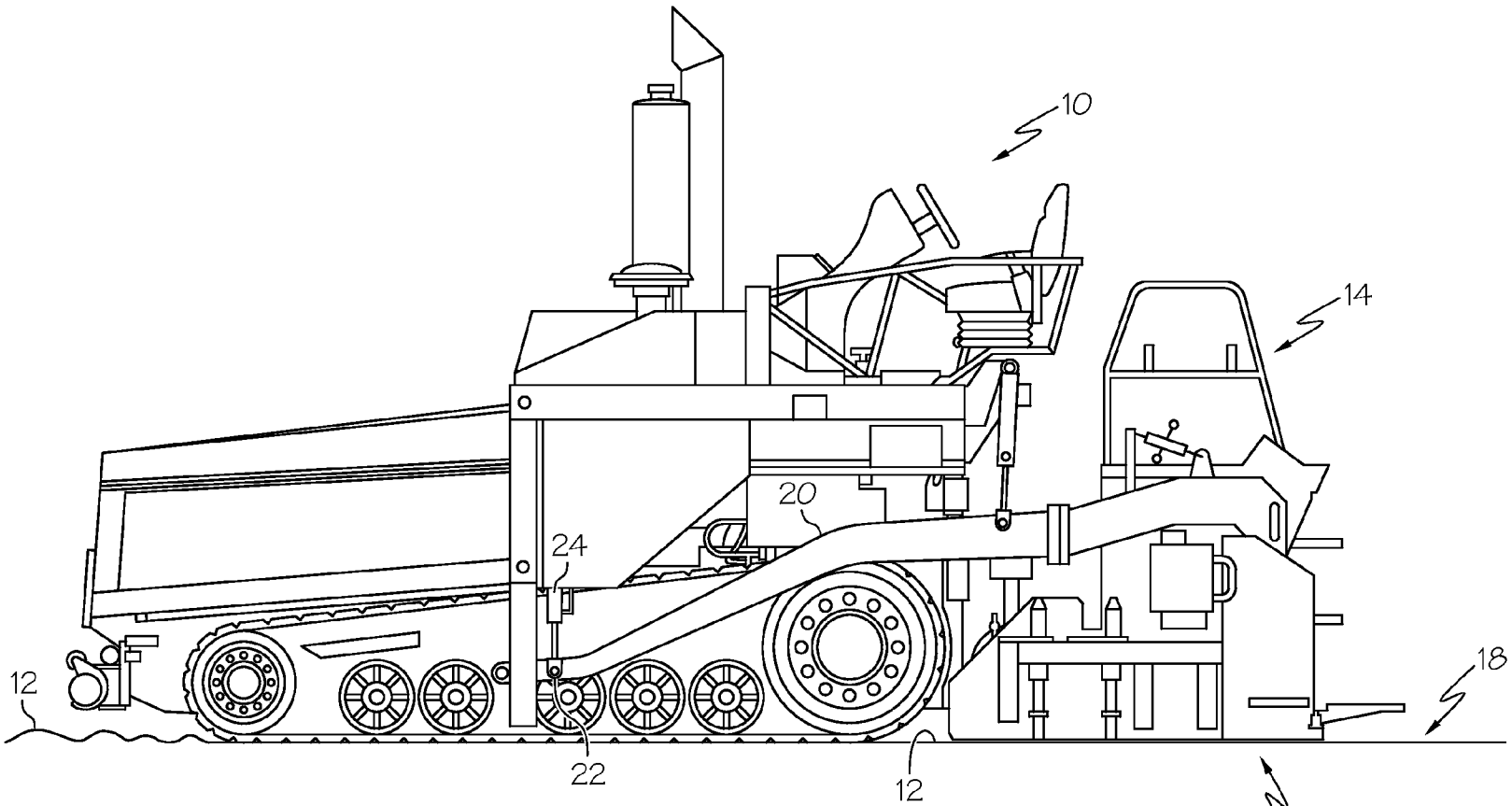
FIG. 1 (PRIOR ART)
FIG. 1 is a side view of a conventional paving machine for asphalt, including a screed.

Reference is made to FIG. 1 which shows an asphalt paving machine 10 that applies asphalt material to a subgrade 12 at a work site. The paving machine 10 includes a floating screed 14 having a screed plate 16. The machine 10 pulls the screed 14 over the top surface 18 of the material deposited behind the machine. The floating screed 14 is attached to the machine 10 by a tow arm 20 at a tow point 22 on the tow arm. The vertical height of the tow point 22 is controlled by an hydraulic cylinder 24 on the machine. The screed 14 smoothes the top surface 18 and determines the thickness of the material on the subgrade as the height of the tow point 22 is adjusted. Although only one tow arm 20 can be seen in the drawings, it will be appreciated that the screed 14 will be pulled by a pair of such tow arms 20, one on each side of the screed, with both of the tow arms being raised and lowered at tow points. The movement of the tow arms is typically controlled independently.

Figure 2:
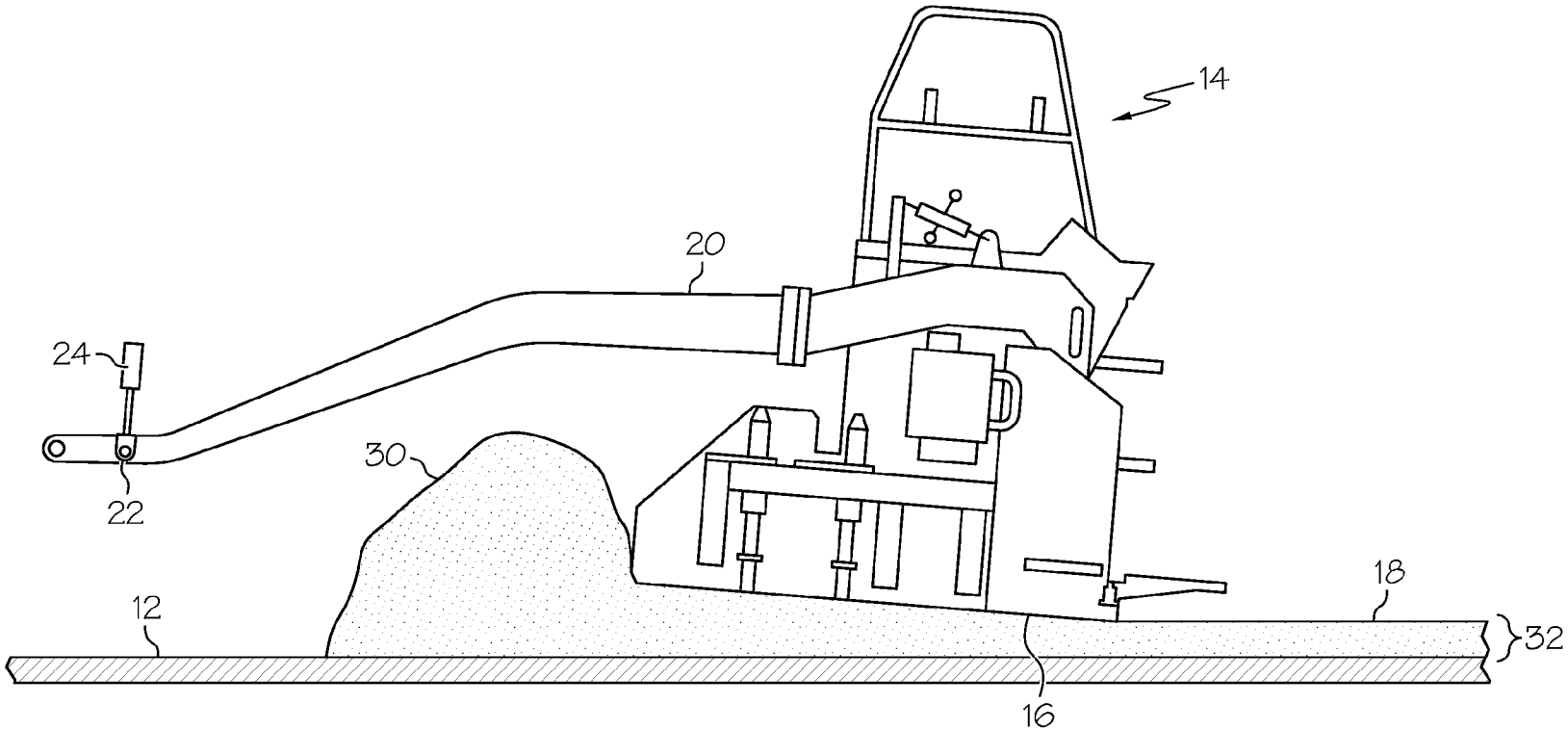
FIG. 2 (PRIOR ART)
FIG. 2 is a diagrammatic representation of the screed, showing the application of asphalt to a surface.

As will be appreciated, and in reference to FIG. 2, the asphalt screed 14 is dragged behind a paving machine (not shown) which deposits a quantity of hot asphalt paving material 30 on the subgrade 12. The screed 14 is designed to "float" over the newly paved surface. Raising and lowering the tow points 22 with the cylinders 24 raises and lowers the front of the screed 14 with the result that the angle of attack of the screed plate 16 on the bottom of the screed 14 is changed. This will, in turn, change the thickness 32 of the layer of asphalt material deposited by the paver.

Figure 3:
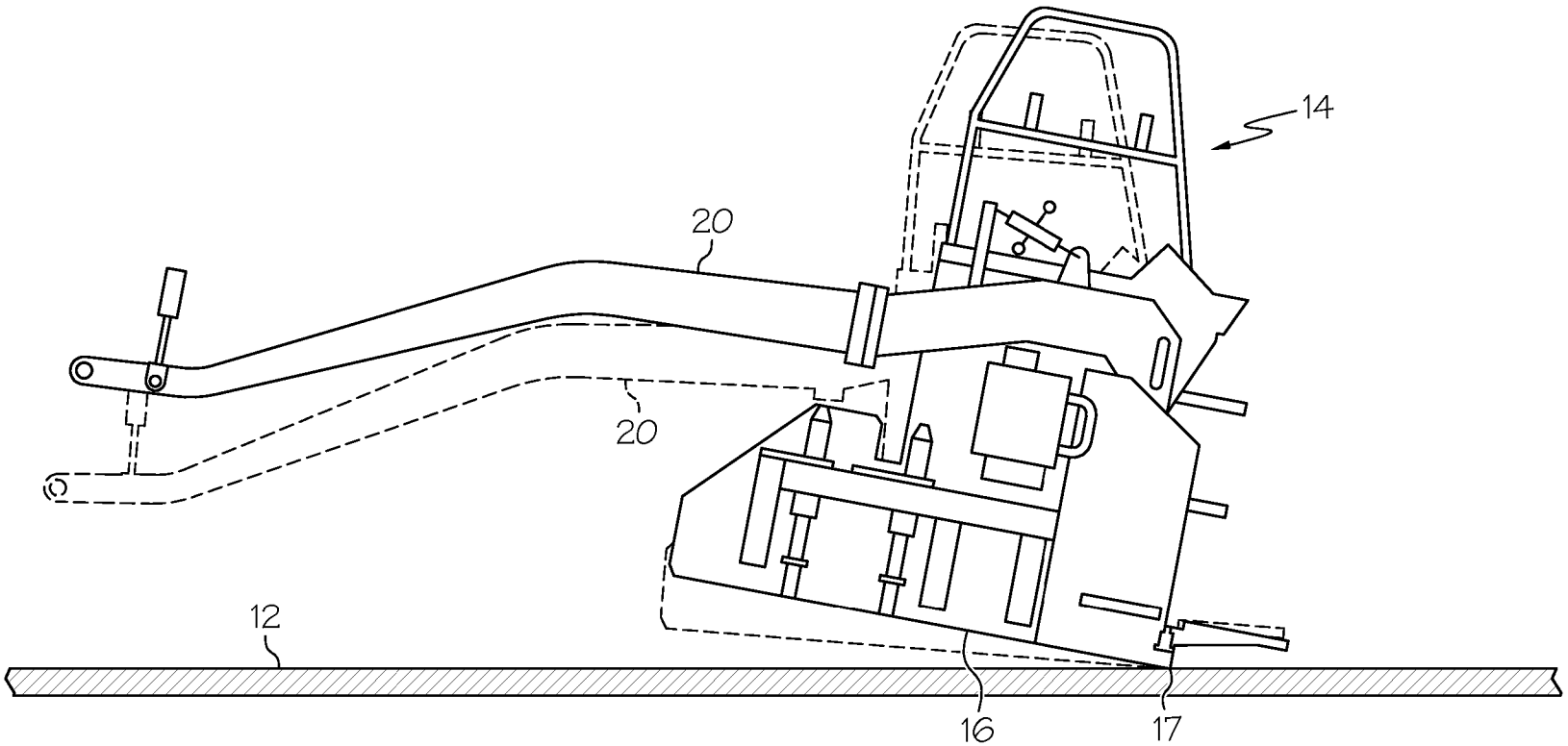
FIG. 3 (PRIOR ART)
FIG. 3 is a view of the screed, similar to FIG. 2, illustrating the manner in which the screed pitches forward and aft as the tow arm is lowered and raised.
Figure 4:
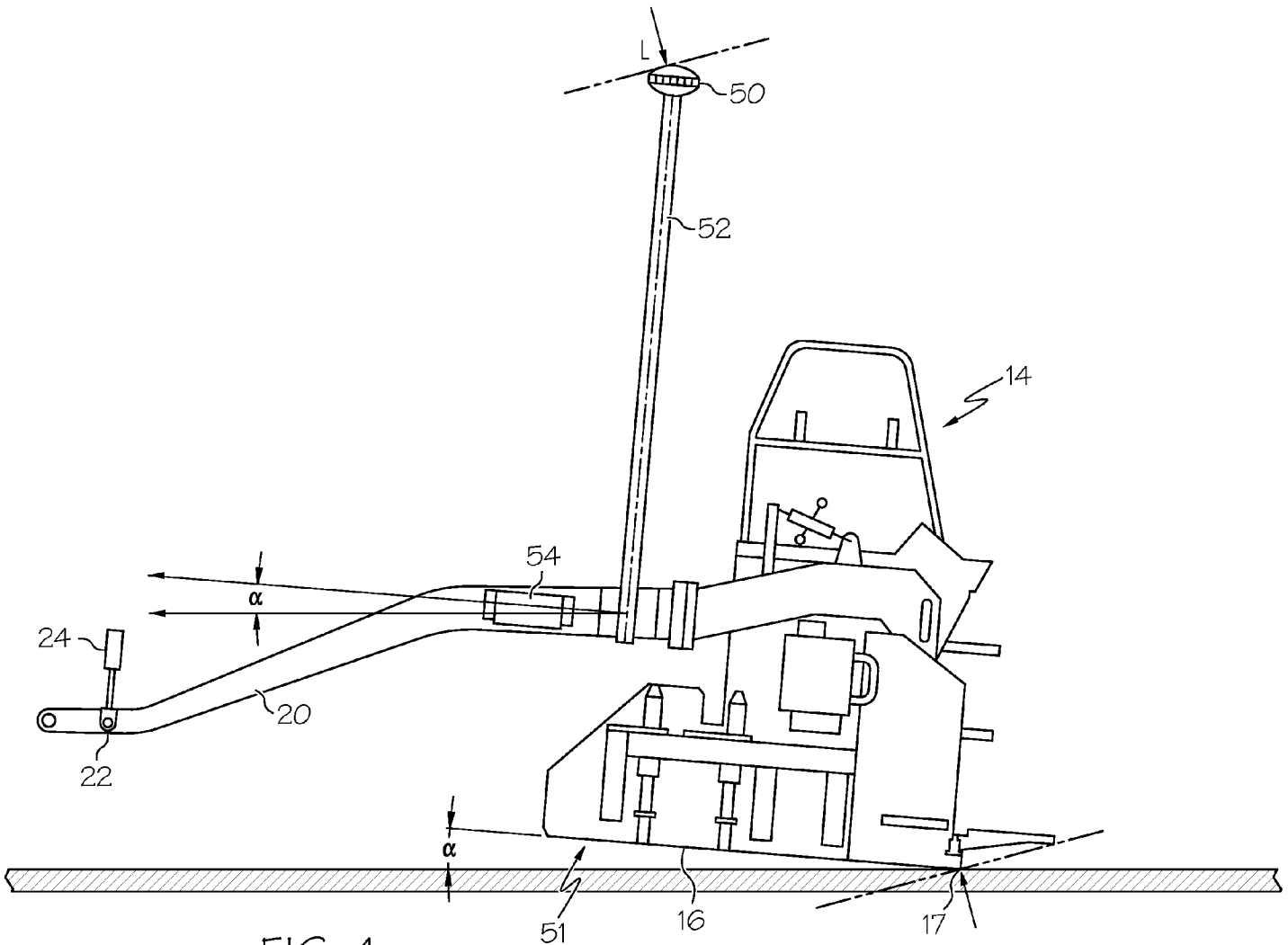
FIG. 4 is a view of the screed, similar to FIG. 2, showing it fitted with sensors on masts.

As illustrated in FIG. 3, if a stationary screed 14, resting on a subgrade 12, were to have its tow arms 20 raised and lowered, the screed 14 would pivot about the trailing edge 17 of the screed plate 16, with the edge 17 remaining in contact with the subgrade 12. The angle of attack of the screed plate 16 would change relative to the ground surface. When asphalt material is introduced in front of the screed 14 from the paver, the screed 14 will ride up over the material to a degree depending on the screed angle of attack, the travel speed of the screed, the consistency and temperature of the asphalt material, the weight of the screed, and various other factors. If speed, the amount of the material in front of the screed, the ground conditions and all other conditions remain constant, the screed will settle to a constant, steady state angle of attack, and the resulting mat of asphalt will be laid with a constant thickness.

When the tow point cylinders are raised, there is a corresponding initial change to the screed angle of attack with the screed pivoting upward about the trailing edge 17 of the screed plate 16. However, as the paver moves forward, the screed trailing edge 17 will begin to rise due to the increased angle of attack acting on the head of material in front of the screed. As the trailing edge 17 slowly rises, the angle of attack slowly reduces until a new steady state is reached. In practice, the steady state angle of attack will tend to remain relatively constant, such that a change in tow point height will result in a corresponding change in the height of the trailing edge 17 of the screed plate 16 after the screed has travel a short distance, on the order of several lengths of a tow arm. The same effect can be seen when the tow point cylinders are lowered. The resulting mat thickness will eventually be reduced by the same distance once the screed settles to a steady state after moving far enough forward.

The control of the screed is effected in part by a three dimensional control system which monitors the three dimensional position of a sensor 50 and then determines the position of point 51 under the sensor 50. Point 51 is a point in space below the mast 52 that would be at ground level if the screed angle of attack were zero. The hydraulic cylinder 24 is extended and retracted to lower and raise the tow point 22 of the tow arm so that point 51 is controlled in height. The system, explained below in greater detail, then also monitors the trailing edge 17 of the screed plate 16 and the height at the trailing edge 17 with the desired height at the trailing edge to alter the set point to maintain a desired top surface elevation for the material. As described previously, the height of the paved surface, prior to any subsequent rolling operation, is defined by the height of the screed trailing edge 17. In order to control the trailing edge 17 height, the control system utilizes a height sensor that determines the height of the trailing edge 17 of the screed plate 16, so that it can be compared against a desired height. Appropriate corrections in the tow point height are made in response to the result of this comparison. It will be appreciated that the opposite side of the screed may be simultaneously controlled in an identical manner. The arrangement includes a first sensor 50, shown as a robotic total station target, mounted on the floating screed 14 by means of a mast 52 for sensing three-dimensional position, and a second sensor, shown as inclinometer 54, for sensing the pitch a of the screed. As is known a robotic total station directs a beam at the target 50, measures the time of flight and the direction of the beam, and then transmits via a radio link the position of the target. As the target moves, the robotic total station tracks the movement to provide updated position information.

Figure 5:
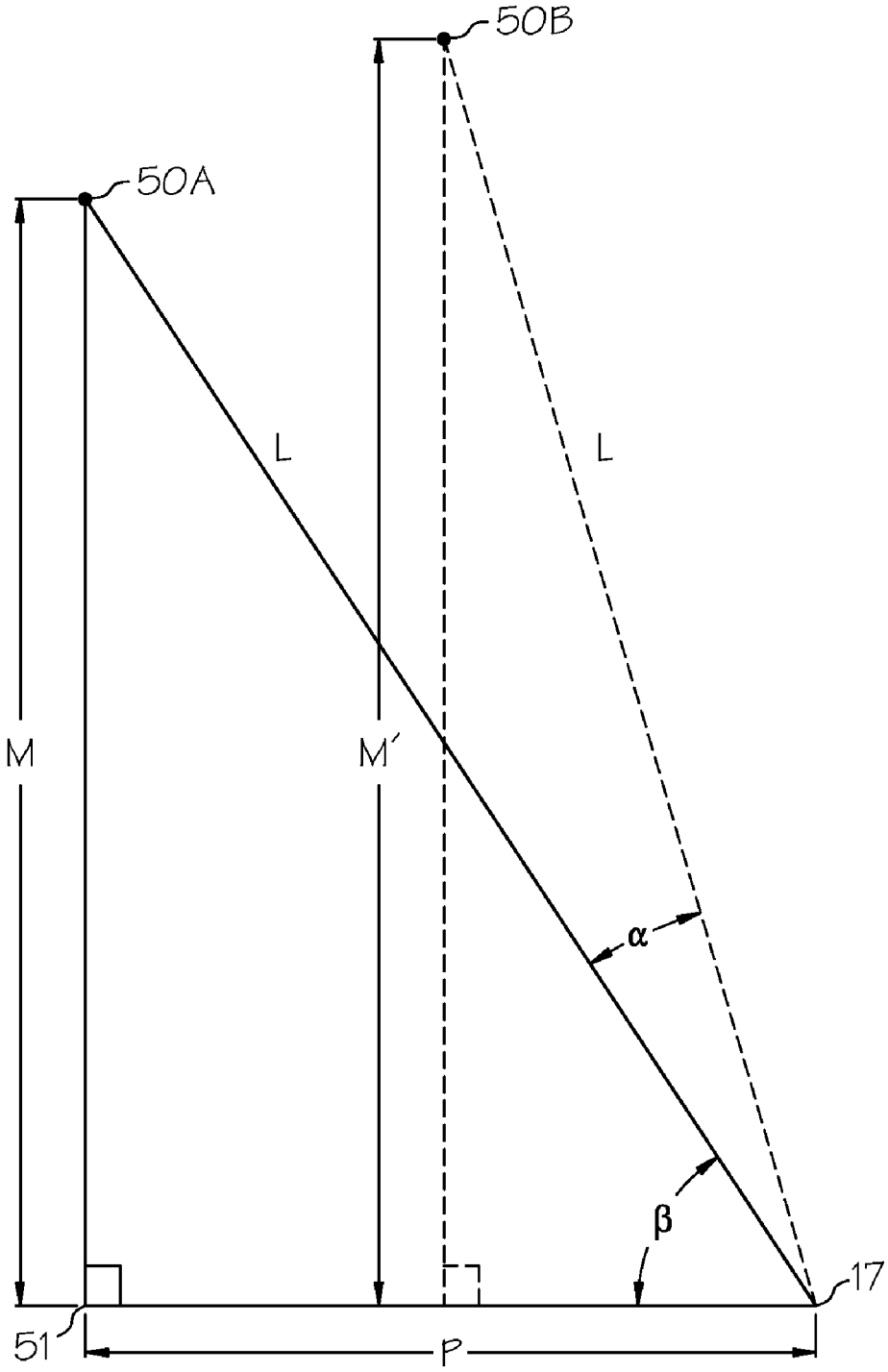
FIG. 5 is a diagrammatic view, illustrating the geometry of tilting of the screed and mast.

FIG. 5 is useful in describing the position of the sensor 50 in relation to the trailing edge 17 of the screed plate 16. The height of the sensor 50 at position 50A above the screed plate 16 (including the trailing edge 17) when the mast 52 is vertical and the screed plate 16 is horizontal, is indicated as M, and the distance from the point 51 on the screed, which is beneath the sensor when the mast 52, is vertical and the screed plate 16 is horizontal, and the trailing edge 17 is indicated as P. The height of the sensor at position 50B above the trailing edge 17 of the screed plate 16 when the screed 14 is tilted back by an angle $\alpha$ is indicated as M'. The distance L between the sensor and the trailing edge 17 of the screed plate 16, of course, remains a constant for a given screed set up. In reference to FIG. 5, it will be appreciated that:

$$\sin(\alpha+\beta)=M'/L$$

Therefore, $$M'=L\sin(\alpha+\beta).$$

Expanding, $$M'=L\sin(\alpha)\cos(\beta)+L\cos(\alpha)\sin(\beta).$$

Substituting, $$M'=L\sin(\alpha)(P/L)+L\cos(\alpha)(M/L),$$

so that, $$M'=P\sin(\alpha)+M\cos(\alpha).$$

Therefore, if the angle $\alpha$ is measured, the distance M' of the trailing edge 17 of the screed plate 16 below and behind the sensor 50 is easily determined. In order to measure the trailing edge height directly behind the sensor 50, a pitch sensor 54 is provided, which allows the system to account for changes in the screed angle of attack $\alpha$. As a consequence, the elevation of the trailing edge of the screed plate behind the mast 52 is simply the elevation of the sensor 50, minus the distance M'. If the elevation of the edge 17 at the opposite side of the screed is determined in a similar manner, the elevation of the edge at points between the two sides of the screed can be determined by simple interpolation. It will be appreciated that if the screed 14 has a significant cross-slope inclination, this will impact the determination of the height of the trailing edge 17, as well, and appropriate corrections will be necessary. An additional inclinometer may be mounted on the screed to determine the cross-slope inclination. It is not possible to use the position of the trailing edge 17 of the screed in a straight forward feedback loop to control the screed height, because the feedback gain is zero at edge 17—i.e., the sensor will not detect any change in height in response to changes in the elevation of the tow point 22. Hence, a three dimensional position control is used, with a secondary feedback loop incorporated in the control system in which small adjustments in the set point are made, based on the errors in the height of the trailing edge 17 as compared to a desired height. As explained below, the set point is changed in ways that smooth the resulting surface of the material.

As will be appreciated, a control system for a screed of this type can only change the extension of the tow point cylinder 24 and the height of the tow point 22, and this does not have a direct and immediate influence on the vertical height of the trailing edge 17. Furthermore, even at relatively fast paving speeds, there is a significant time lag between when the position of the tow point 22 is changed, and a resulting change in height of the trailing edge 17 of the screed plate 16.

An important consideration in the operation of a paver control system is that it must provide sufficient surface smoothness. Specifically, it must not cause the screed 14 to make large, abrupt height changes that would result in the desired level of surface smoothness being achieved. Typically, it is desired that there be no more than a maximum 3 mm deviation in the surface over 3 meters of surface travel. Also, the control system must provide for the natural lag of the screed trailing edge response to height changes made at the tow points 22. In practice, the magnitude of this lag is primarily a function of the distance traveled by the screed, rather than a time delay.

The control system meets both of these requirements by making relatively infrequent adjustments (e.g., no less than 5 meters travel distance between changes) following a procedure explained by the pseudo code below:

```
BEGIN LOOP:
Start "monitoring" raise/lower values from the sensor
Travel some distance D forward (e.g., 5 meters)
Calculate "filtered" raise/lower value δH over last travel distance D
Hard limit δH to a maximum value (e.g. +/− 3mm) to avoid large step
changes
IF δH is above a minimum raise threshold (e.g. +1mm) THEN
    Increase height adjustment by δH
ELSE IF δH above a minimum lower threshold (e.g. −1mm) THEN
    Decrease height adjustment by δH
END LOOP
```

Note that this limits the amount of adjustment in the tow point height that can be made over each 5 meters of travel to no more than 3 mm, and further results in no change in tow point height in the event that δH is less than +/−1 mm. These distances and values are merely exemplary. It may be desirable not to completely limit the height deviation, but rather to adjust it in a non-linear manner with the deviation being reduced somewhat for large values.

Figure 6:
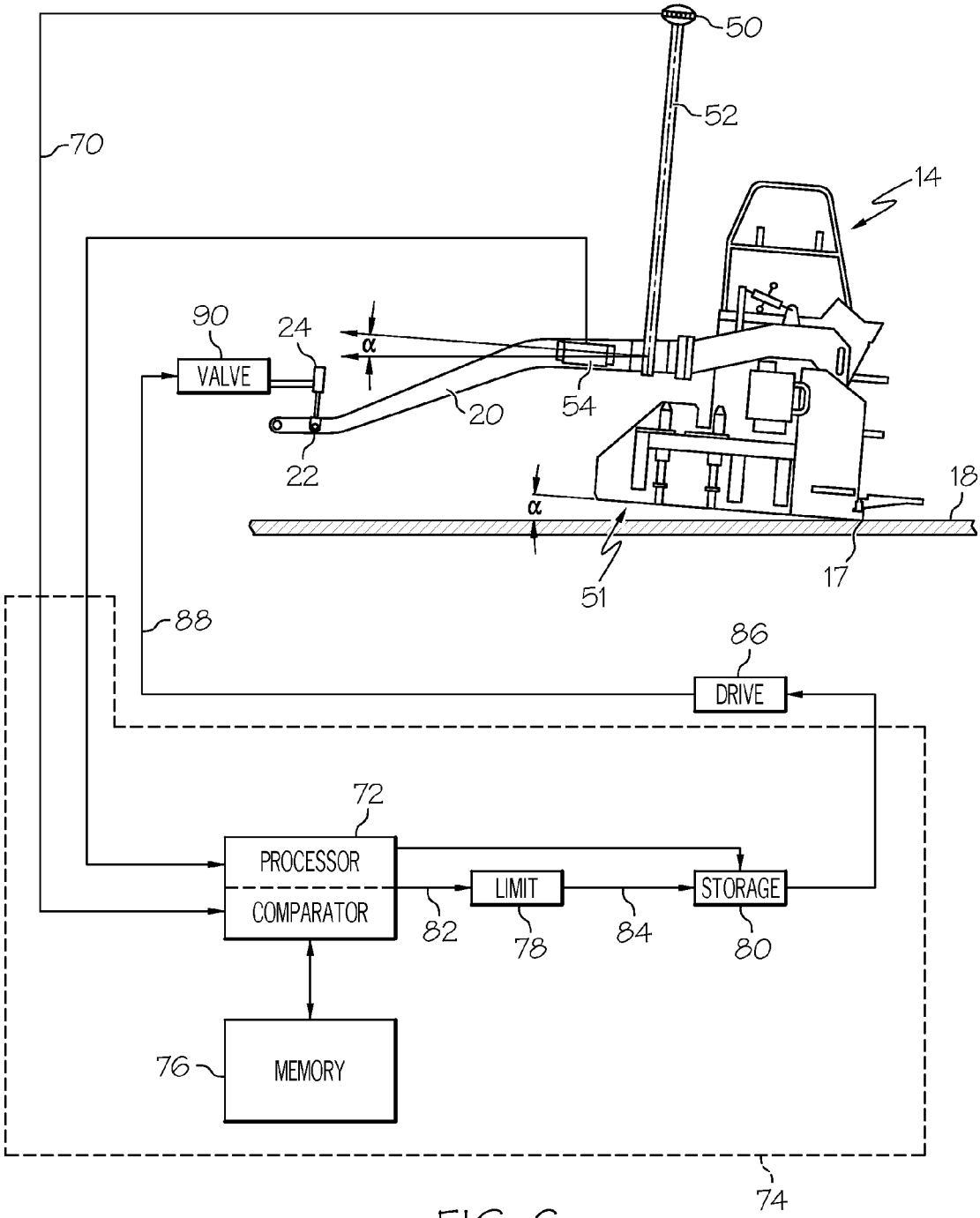
FIG. 6 is a diagrammatic view of the screed and a diagrammatic representation of a control system.
Figure 6A:
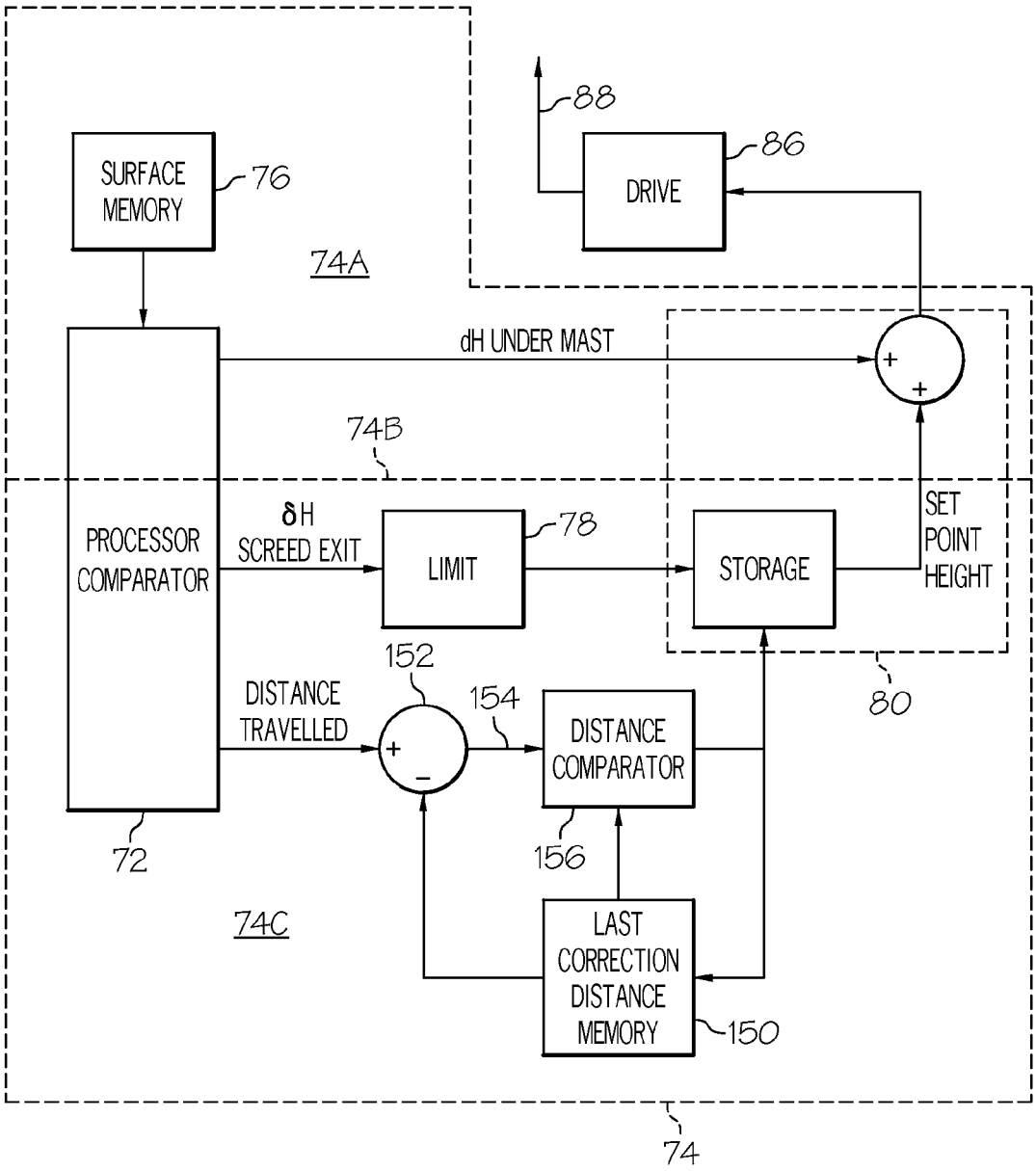
FIG. 6A is a schematic diagram, illustrating the control system of FIG. 6 in somewhat greater detail.

Reference is made to FIGS. 6 and 6A, which illustrate a simplified control 74 for one side of a screed 14. For ease of explanation, the cross slope calculations and associated control are omitted from these figures. Referring first to FIG. 6, it is seen that the sensor 50 on mast 52 provides an output on line 70, indicating the instantaneous three dimensional position of the sensor, to a processor 72. The control 74 functionally includes processor circuit 72, memory 76, limit circuit 78, and storage circuit 80. Although illustrated in FIG. 6 as made up of four separate components, the control 74 may actually be implemented in a programmed computer. The processor circuit 72 is also responsive to the inclinometer 54, and based on information from the sensor 50 and the inclinometer 54, determines the height of the trailing edge 17 of the screed plate 16 and the movement of the screed 14 over the top surface of the asphalt material. The processor also determines the height of the point 51 below the sensor 50, and calculates a tow point correction value based on the difference between this and a desired height. Memory 76 stores data defining a desired contour for the top surface of the asphalt material that is to be applied over the subgrade at the work site. The comparator implemented by processor 72 is responsive to the contour memory 76 and to the sensor 50 for deriving a height error value δH and supplying it on line 82. Limiter 78 is responsive to the height error value, limits or adjusts the height error value in a desired manner, and then provides the adjusted height error value on line 84 to storage circuit 80. The height error value may be adjusted, for example, by attenuating it slightly, with greater levels of attenuation being used as the height error value increases. Circuit 80 is responsive to the limiter 78 and to the processor circuit 72 for combining the adjusted height error value with a tow point correction value and supplying this to a valve control drive 86. Valve control drive 86, in turn, provides a control on line 88 to an hydraulic valve 90 such that the tow point 22 is adjusted by no more than a predetermined amount as the screed plate travels a predetermined distance. The processor 72 determines the amount of travel from the sensor receiver outputs, and then controls the storage circuit 80 so that an adjusted δH stored in circuit 80 is not supplied to drive 86 until the screed 14 has traveled across the worksite by the predetermined distance.

FIG. 6A provides somewhat greater detail with respect to the control 74. The portion of control indicated at 74A above dashed line 74B corresponds to a conventional screed control in which the difference dH between the elevation under the sensor and a set elevation is used to provide a signal to a valve control drive 86. The portion of the control 74 indicated at 74C below dashed line 74B enhances significantly the operation of the screed control. As illustrated, the distance traveled is continuously calculated by the processor/comparator box 72, and the last correction distance from memory 150 is subtracted at 152 to derive a "distance since last update" value on 154. A comparator 156 then compares this value to see if it is greater than some minimum value, such as, for example 5 meters. If so, the output of the limiter 78 is stored as the new value in the storage circuit 80, and the last correction distance is updated with the current distance.

Figure 7:
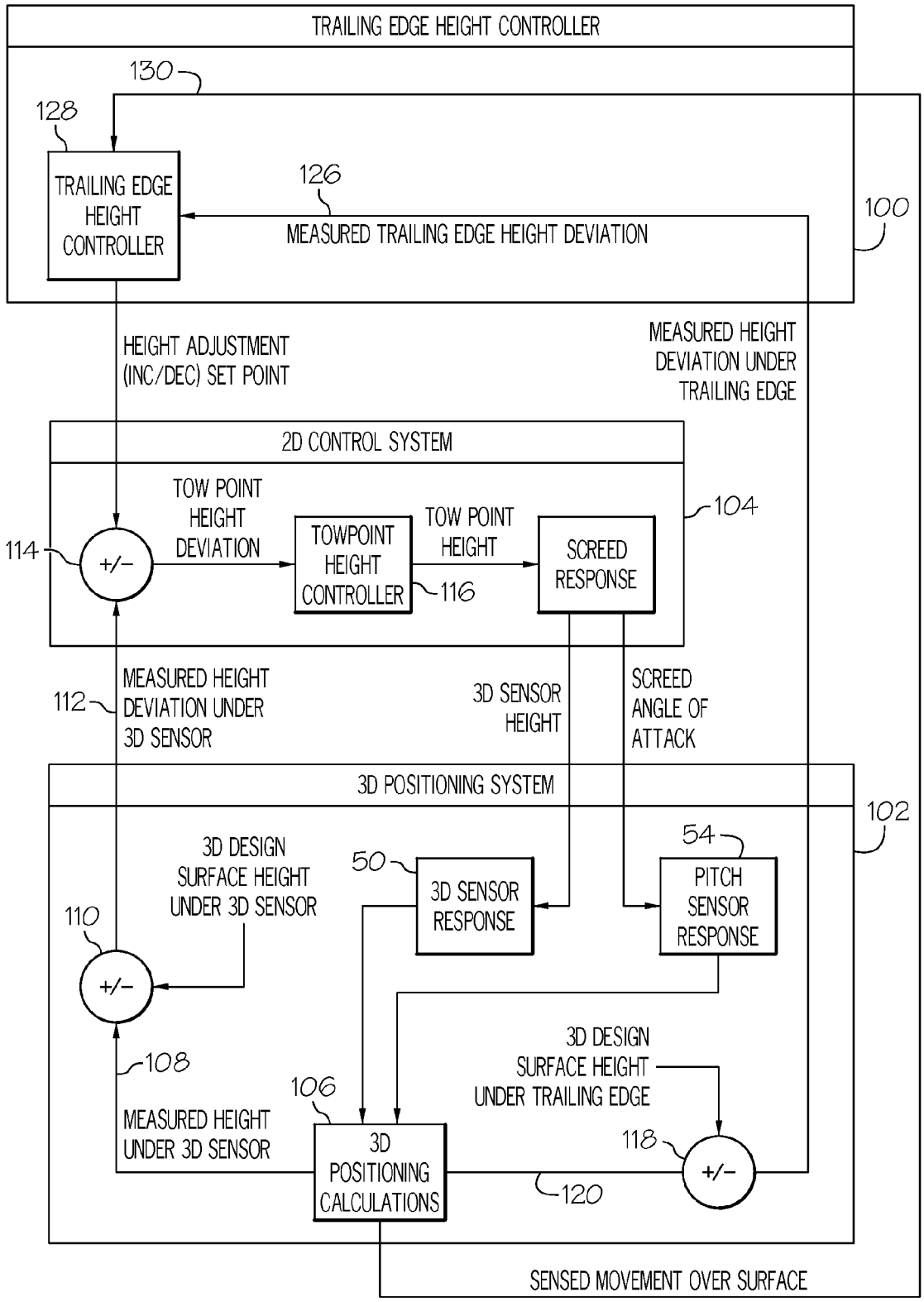
FIG. 7 is a diagrammatic representation of a control system which implements an outer loop in addition to a 2D control system and a 3D positioning system.

The method of controlling paver that applies asphalt to a subgrade and pulls a floating screed 14 having a screed plate 16 over the top surface of the asphalt material 18 behind the paver is apparent from the above description and is illustrated in FIG. 7, and also with reference to FIG. 2. The floating screed 14 is attached to the paver by a tow arm 20 at a tow point 22 on the tow arm 20, and the vertical height of the tow point is controlled by hydraulic cylinder 24 on the paver in response to a valve control signal applied to an hydraulic valve 90. The screed determines the thickness 32 of the asphalt material on the subgrade 12 and is manipulated by adjusting the height of the tow point 22 such that the top surface of the material follows a reference surface.

The position of the trailing edge 17 of the screed plate 16, the position of the point 51 on the screed plate 16 below the sensor 50, and the movement of the screed 14 over the top surface of the material are determined using the sensor and inclinometer data. Further, if the screed is inclined across its width, i.e., in a direction perpendicular to its direction of movement, then the height of the trailing edge 17 of the screed across its width may be determined from the output of a second sensor 50, and an inclinometer that senses the cross slope angle. If the trailing edge 17 of the screed defines a straight line, then a determination of the heights of the two ends of the screed permits simple interpolation to be used to determine the height of the trailing edge 17 of the screed plate 16 at any point.

The method of controlling a machine, as illustrated in FIG. 7, essentially adds an outer control loop 100 Trailing Edge Height Controller, to the 3D Positioning System 102 and the 2D Control System 104 which are primarily used for screed control. The sensors 50 and 54 have their outputs supplied to 106 where the three dimensional positions of the screed trailing edge 17 and point 51 under the sensor 50 are calculated. The measured height under the 3D sensor is provided on line 108 and compared to a surface design height at 110. A tow point correction value is provided on line 112 to the 2D Control 104 for adjustment of the tow point height. However, before the tow point height is adjusted, an adjusted height error value is combined at 114 with the tow point correction value to drive the tow point cylinder 24 via controller 116. The outer control loop 100 senses the trailing edge error by comparing at 118 the desired surface height under the trailing edge 17 with the calculated surface height at point 17 on 120. This produces a measured height deviation under the trailing edge 17. The measured trailing edge height error value on 126 is then limited or adjusted at 128, and supplied for combination with the tow point correction value at 114. The controller 128 is responsive to a movement value on 130 for metering the adjusted height error values in accordance with the movement of the screed over the material. The movement of the screed over the material can be determined by noting the successive X and Y coordinates of the sensor 50 as the screed moves.

What is claimed is:

1. A control for a machine that applies a material to a subgrade at a work site and pulls a floating screed having a screed plate over the top surface of the material behind the machine, said floating screed being attached to the machine by a tow arm at a tow point on said tow arm, the vertical height of said tow point being controlled by an hydraulic cylinder on said machine in response to a valve control signal applied to an hydraulic valve by a valve control drive, said screed determining the thickness of the material on the subgrade and being manipulated by adjusting the height of said tow point, comprising:

a first sensor mounted on the floating screed for sensing three-dimensional position, a second sensor for sensing the pitch of said screed, a memory for storing a desired contour of the top surface of the material applied to said subgrade at said work site, a processor circuit, responsive to said first and second sensors and to said memory, for determining the height of the trailing edge of the screed plate and the movement of the screed over the top surface of the material, for deriving a height error value, and for providing an adjusted height error value to said valve control drive such that the tow point may be adjusted by a predetermined amount as said screed plate travels a predetermined minimum distance.

2. The control for a machine that applies a material to a subgrade and pulls a floating screed having a screed plate over the top surface of the material behind the machine according to claim 1, in which said first sensor comprises a sensor, mounted on a mast on the screed, for sensing the height of the material surface.

3. The control for a machine that applies a material to a subgrade and pulls a floating screed having a screed plate over the top surface of the material behind the machine according to claim 1, in which said first sensor comprises a target for an automated total station, mounted on the screed, for sensing the height of the material surface.

4. The control for a machine that applies a material to a subgrade and pulls a floating screed having a screed plate over the top surface of the material behind the machine according to claim 1, in which said second sensor comprises an inclinometer mounted on said screed.

5. The control for a machine that applies a material to a subgrade and pulls a floating screed having a screed plate over the top surface of the material behind the machine according to claim 1, in which said a processor circuit, and said memory are implemented in a programmable computer.

6. A method of controlling a machine that applies a material to a subgrade and pulls a floating screed having a screed plate over the top surface of the material behind the machine, said floating screed being attached to the machine by a tow arm at a tow point on said tow arm, the vertical height of said tow point being controlled by an hydraulic cylinder on said machine in response to a valve control signal applied to an hydraulic valve, said screed determining the thickness of the material on the subgrade and being manipulated by adjusting the height of said tow point such that the top surface of the material follows a reference surface, said machine having a sensor for sensing the position of the screed forward of the trailing edge of the screed plate, comprising the steps of:

sensing the height of the screed plate under the sensor and providing a tow point correction value, sensing the three-dimensional position of the trailing edge of the screed, determining the height of the trailing edge of the screed plate and the movement of the screed over the top surface of the material, storing a desired contour of the top surface of the material applied to said subgrade at said work site, comparing the desired height of the trailing edge of the screed plate with the determined height of the trailing edge of the screed plate as it moves over the top surface of the material and deriving a height error value, adjusting the height error value, and combining said height error value with said tow point correction value in accordance with the movement of the screed plate over the top surface of the material and providing the combined value to said valve control drive such that the tow point may be adjusted by a predetermined amount as said screed plate travels a predetermined minimum distance.

7. The method of controlling a machine that applies a material to a subgrade and pulls a floating screed having a screed plate over the top surface of the material behind the machine, according to claim 6, in which the step of sensing the three-dimensional position of the trailing edge of the screed includes the step of sensing the position of sensors mounted on supports secured to said screed.

8. The method of controlling a machine that applies a material to a subgrade and pulls a floating screed having a screed plate over the top surface of the material behind the machine, according to claim 6, in which the step of sensing the three-dimensional position of the trailing edge of the screed includes the step of sensing the position of automated total station targets mounted on supports secured to said screed.

9. The method of controlling a machine that applies a material to a subgrade and pulls a floating screed having a screed plate over the top surface of the material behind the machine, according to claim 6, in which the step of sensing the three-dimensional position of the trailing edge of the screed further includes the step of sensing the inclination of the screed.

10. The method of controlling a machine that applies a material to a subgrade and pulls a floating screed having a screed plate over the top surface of the material behind the machine, according to claim 6, in which the step of adjusting said height error value includes the step of limiting said height error value.

11. A control for a machine that applies a material to a subgrade at a work site and pulls a floating screed having a screed plate over the top surface of the material behind the machine, said floating screed being attached to the machine by a tow arm at a tow point on said tow arm, the vertical height of said tow point being controlled by an hydraulic cylinder on said machine in response to a valve control signal applied to an hydraulic valve by a valve control drive, said screed determining the thickness of the material on the subgrade and being manipulated by adjusting the height of said tow point, comprising:

a plurality of sensors for sensing the position and orientation of the floating screed, a processor circuit, responsive to said plurality of sensors, for determining the height of the trailing edge of the screed plate and the movement of the screed over the top surface of the material, and for deriving a height error value for determining a screed plate height and providing a tow point correction value, and for combining said tow point correction value and said height error value to said valve control drive such that the tow point may be adjusted by no more than a predetermined amount as said screed plate travels a predetermined minimum distance.

12. The control for a machine that applies a material to a subgrade and pulls a floating screed having a screed plate over the top surface of the material behind the machine according to claim 11, in which said plurality of sensors comprise one or more sensors, mounted on the screed, for sensing the height of the material surface.

13. The control for a machine that applies a material to a subgrade and pulls a floating screed having a screed plate over the top surface of the material behind the machine according to claim 11, in which said plurality of sensors comprise an inclinometer mounted on said screed.

14. The control for a machine that applies a material to a subgrade and pulls a floating screed having a screed plate over the top surface of the material behind the machine according to claim 13, in which said plurality of sensors comprise one or more robotic total station targets, mounted on the screed, for sensing the height of the material surface.

15. The control for a machine that applies a material to a subgrade and pulls a floating screed having a screed plate over the top surface of the material behind the machine according to claim 11, in which said a processor circuit is implemented in a programmable computer.

16. A method of controlling a machine that applies a material to a subgrade and pulls a floating screed having a screed plate over the top surface of the material behind the machine, said floating screed being attached to the machine by a tow arm at a tow point on said tow arm, the vertical height of said tow point being controlled by an hydraulic cylinder on said machine in response to a valve control signal applied to an hydraulic valve, said screed determining the thickness of the material on the subgrade and being manipulated by adjusting the height of said tow point such that the top surface of the material follows a reference surface, comprising the steps of:

determining the height of the top surface beneath a sensor ahead of the trailing edge of the screed plate, comparing the height of the top surface beneath a sensor ahead of the trailing edge of the screed plate with a design surface height to provide a tow point correction value, determining the height of the trailing edge of the screed plate and the movement of the screed over the top surface of the material, comparing the desired height of the trailing edge of the screed plate with the determined height of the trailing edge of the screed plate as it moves over the top surface of the material and deriving a height error value, adjusting said height error value, and combining said adjusted height error value with said tow point correction value in accordance with the movement of the trailing edge of the screed plate over the top surface of the material and providing a combined value to said valve control drive such that the tow point may be adjusted by a predetermined amount as said screed plate travels a predetermined minimum distance.

17. The method of controlling a machine that applies a material to a subgrade and pulls a floating screed having a screed plate over the top surface of the material behind the machine, according to claim 16, in which the step of applying said limited height error value in accordance with the movement of the trailing edge of the screed plate over the top surface of the material to said valve control drive such that the tow point may be adjusted by no more than a predetermined amount as said screed plate travels a predetermined minimum distance includes the step of determining the distance of travel using a robotic total station target on said screed.

18. The method of controlling a machine that applies a material to a subgrade and pulls a floating screed having a screed plate over the top surface of the material behind the machine, according to claim 16, further comprising the step of adjusting said height error value includes the step of limiting said height error value.

* * * * *

UNITED STATES PATENT AND TRADEMARK OFFICE

CERTIFICATE OF CORRECTION

PATENT NO. : 8,371,769 B2
APPLICATION NO. : 12/759846
DATED : February 12, 2013
INVENTOR(S) : Andrew James Worsley et al.

It is certified that error appears in the above-identified patent and that said Letters Patent is hereby corrected as shown below:

In the Specification

Col. 5, Line 18, "the pitch a of the screed. As is known a robotic total station" should read --the pitch α of the screed. As in known a robotic total station--.

Signed and Sealed this
Sixteenth Day of September, 2014

Michelle K. Lee

Michelle K. Lee
*Deputy Director of the United States Patent and Trademark Office*